US008348697B2

(12) United States Patent
Zraik

(10) Patent No.: US 8,348,697 B2
(45) Date of Patent: Jan. 8, 2013

(54) COAXIAL CABLE CONNECTOR HAVING SLOTTED POST MEMBER

(75) Inventor: Souheil Zraik, Liverpool, NY (US)

(73) Assignee: John Mezzalingua Associates, Inc., E. Syracuse, NY (US)

( * ) Notice: Subject to any disclaimer, the term of this patent is extended or adjusted under 35 U.S.C. 154(b) by 74 days.

(21) Appl. No.: 13/092,219

(22) Filed: Apr. 22, 2011

(65) Prior Publication Data

US 2012/0270440 A1 Oct. 25, 2012

(51) Int. Cl.
*H01R 9/05* (2006.01)

(52) U.S. Cl. ..... 439/578; 439/321

(58) Field of Classification Search ..... 439/578–585, 439/321, 320

See application file for complete search history.

(56) References Cited

U.S. PATENT DOCUMENTS

| | | | |
|---|---|---|---|
| 1,667,485 | A | 4/1928 | MacDonald |
| 1,766,869 | A | 6/1930 | Austin |
| 2,258,737 | A | 10/1941 | Browne |
| 2,325,549 | A | 7/1943 | Ryzowitz |
| 2,480,963 | A | 9/1949 | Quinn |
| 2,544,654 | A | 3/1951 | Brown |
| 2,549,647 | A | 4/1951 | Turenne |
| 2,694,187 | A | 11/1954 | Nash |
| 2,754,487 | A | 7/1956 | Carr et al. |
| 2,755,331 | A | 7/1956 | Melcher |
| 2,757,351 | A | 7/1956 | Klostermann |
| 2,762,025 | A | 9/1956 | Melcher |
| 2,805,399 | A | 9/1957 | Leeper |
| 2,870,420 | A | 1/1959 | Malek |
| 3,001,169 | A | 9/1961 | Blonder |
| 3,015,794 | A | 1/1962 | Kishbaugh |
| 3,091,748 | A | 5/1963 | Takes et al. |
| 3,094,364 | A | 6/1963 | Lingg |
| 3,184,706 | A | 5/1965 | Atkins |
| 3,196,382 | A | 7/1965 | Morello, Jr. |
| 3,245,027 | A | 4/1966 | Ziegler, Jr. |
| 3,275,913 | A | 9/1966 | Blanchard et al. |
| 3,278,890 | A | 10/1966 | Cooney |
| 3,281,757 | A | 10/1966 | Bonhomme |
| 3,292,136 | A | 12/1966 | Somerset |
| 3,320,575 | A | 5/1967 | Brown et al. |
| 3,321,732 | A | 5/1967 | Forney, Jr. |
| 3,336,563 | A | 8/1967 | Hyslop |

(Continued)

FOREIGN PATENT DOCUMENTS

CA 2096710 A1 11/1994

(Continued)

OTHER PUBLICATIONS

Digicon AVL Connector. ARRIS Group Inc. [online]. 3 pages. [retrieved on Apr. 22, 2010]. Retrieved from the Internet< URL: http://www.arrisi.com/special/digiconAVL.asp>.

*Primary Examiner* — Gary F. Paumen
(74) *Attorney, Agent, or Firm* — Schmeiser, Olsen & Watts, LLP

(57) ABSTRACT

A coaxial cable connector includes a connector body and a post member disposed within the connector body. A coupling nut is threadingly attached to the post member wherein a flanged portion of the post member provides an axial biasing force with regard to an attached interface port. In one version, the flanged portion is slotted.

14 Claims, 8 Drawing Sheets

U.S. PATENT DOCUMENTS

| | | | |
|---|---|---|---|
| 3,348,186 | A | 10/1967 | Rosen |
| 3,350,677 | A | 10/1967 | Daum |
| 3,355,698 | A | 11/1967 | Keller |
| 3,373,243 | A | 3/1968 | Janowiak et al. |
| 3,390,374 | A | 6/1968 | Forney, Jr. |
| 3,406,373 | A | 10/1968 | Forney, Jr. |
| 3,448,430 | A | 6/1969 | Kelly |
| 3,453,376 | A | 7/1969 | Ziegler, Jr. et al. |
| 3,465,281 | A | 9/1969 | Florer |
| 3,475,545 | A | 10/1969 | Stark et al. |
| 3,498,647 | A | 3/1970 | Schroder |
| 3,517,373 | A | 6/1970 | Jamon |
| 3,533,051 | A | 10/1970 | Ziegler, Jr. |
| 3,537,065 | A | 10/1970 | Winston |
| 3,544,705 | A | 12/1970 | Winston |
| 3,551,882 | A | 12/1970 | O'Keefe |
| 3,564,487 | A | 2/1971 | Upstone et al. |
| 3,587,033 | A | 6/1971 | Brorein et al. |
| 3,601,776 | A | 8/1971 | Curl |
| 3,629,792 | A | 12/1971 | Dorrell |
| 3,633,150 | A | 1/1972 | Swartz |
| 3,646,502 | A | 2/1972 | Hutter et al. |
| 3,663,926 | A | 5/1972 | Brandt |
| 3,665,371 | A | 5/1972 | Cripps |
| 3,668,612 | A | 6/1972 | Nepovim |
| 3,669,472 | A | 6/1972 | Nadsady |
| 3,671,922 | A | 6/1972 | Zerlin et al. |
| 3,678,445 | A | 7/1972 | Brancaleone |
| 3,680,034 | A | 7/1972 | Chow et al. |
| 3,681,739 | A | 8/1972 | Kornick |
| 3,683,320 | A | 8/1972 | Woods et al. |
| 3,686,623 | A | 8/1972 | Nijman |
| 3,694,792 | A | 9/1972 | Wallo |
| 3,706,958 | A | 12/1972 | Blanchenot |
| 3,710,005 | A | 1/1973 | French |
| 3,739,076 | A | 6/1973 | Schwartz |
| 3,744,007 | A | 7/1973 | Horak |
| 3,744,011 | A | 7/1973 | Blanchenot |
| 3,778,535 | A | 12/1973 | Forney, Jr. |
| 3,781,762 | A | 12/1973 | Quackenbush |
| 3,781,898 | A | 12/1973 | Holloway |
| 3,793,610 | A | 2/1974 | Brishka |
| 3,798,589 | A | 3/1974 | Deardurff |
| 3,808,580 | A | 4/1974 | Johnson |
| 3,810,076 | A | 5/1974 | Hutter |
| 3,835,443 | A | 9/1974 | Arnold et al. |
| 3,836,700 | A | 9/1974 | Niemeyer |
| 3,845,453 | A | 10/1974 | Hemmer |
| 3,846,738 | A | 11/1974 | Nepovim |
| 3,854,003 | A | 12/1974 | Duret |
| 3,858,156 | A | 12/1974 | Zarro |
| 3,879,102 | A | 4/1975 | Horak |
| 3,886,301 | A | 5/1975 | Cronin et al. |
| 3,907,399 | A | 9/1975 | Spinner |
| 3,910,673 | A | 10/1975 | Stokes |
| 3,915,539 | A | 10/1975 | Collins |
| 3,936,132 | A | 2/1976 | Hutter |
| 3,953,097 | A | 4/1976 | Graham |
| 3,963,320 | A | 6/1976 | Spinner |
| 3,963,321 | A | 6/1976 | Burger et al. |
| 3,970,355 | A | 7/1976 | Pitschi |
| 3,972,013 | A | 7/1976 | Shapiro |
| 3,976,352 | A | 8/1976 | Spinner |
| 3,980,805 | A | 9/1976 | Lipari |
| 3,985,418 | A | 10/1976 | Spinner |
| 4,017,139 | A | 4/1977 | Nelson |
| 4,030,798 | A | 6/1977 | Paoli |
| 4,046,451 | A | 9/1977 | Juds et al. |
| 4,053,200 | A | 10/1977 | Pugner |
| 4,059,330 | A | 11/1977 | Shirey |
| 4,079,343 | A | 3/1978 | Nijman |
| 4,082,404 | A | 4/1978 | Flatt |
| 4,090,028 | A | 5/1978 | Vontobel |
| 4,093,335 | A | 6/1978 | Schwartz et al. |
| 4,106,839 | A | 8/1978 | Cooper |
| 4,125,308 | A | 11/1978 | Schilling |
| 4,126,372 | A | 11/1978 | Hashimoto et al. |
| 4,131,332 | A | 12/1978 | Hogendobler et al. |
| 4,150,250 | A | 4/1979 | Lundeberg |
| 4,153,320 | A | 5/1979 | Townshend |
| 4,156,554 | A | 5/1979 | Aujla |
| 4,165,911 | A | 8/1979 | Laudig |
| 4,168,921 | A | 9/1979 | Blanchard |
| 4,173,385 | A | 11/1979 | Fenn et al. |
| 4,174,875 | A | 11/1979 | Wilson et al. |
| 4,187,481 | A | 2/1980 | Boutros |
| 4,225,162 | A | 9/1980 | Dola |
| 4,227,765 | A | 10/1980 | Neumann et al. |
| 4,229,714 | A | 10/1980 | Yu |
| 4,250,348 | A | 2/1981 | Kitagawa |
| 4,280,749 | A | 7/1981 | Hemmer |
| 4,285,564 | A | 8/1981 | Spinner |
| 4,290,663 | A | 9/1981 | Fowler et al. |
| 4,296,986 | A | 10/1981 | Herrmann, Jr. |
| 4,307,926 | A | 12/1981 | Smith |
| 4,322,121 | A | 3/1982 | Riches et al. |
| 4,326,769 | A | 4/1982 | Dorsey et al. |
| 4,339,166 | A | 7/1982 | Dayton |
| 4,346,958 | A | 8/1982 | Blanchard |
| 4,354,721 | A | 10/1982 | Luzzi |
| 4,358,174 | A | 11/1982 | Dreyer |
| 4,373,767 | A | 2/1983 | Cairns |
| 4,389,081 | A | 6/1983 | Gallusser et al. |
| 4,400,050 | A | 8/1983 | Hayward |
| 4,407,529 | A | 10/1983 | Holman |
| 4,408,821 | A | 10/1983 | Forney, Jr. |
| 4,408,822 | A | 10/1983 | Nikitas |
| 4,412,717 | A | 11/1983 | Monroe |
| 4,421,377 | A | 12/1983 | Spinner |
| 4,426,127 | A | 1/1984 | Kubota |
| 4,444,453 | A | 4/1984 | Kirby et al. |
| 4,452,503 | A | 6/1984 | Forney, Jr. |
| 4,456,323 | A | 6/1984 | Pitcher et al. |
| 4,462,653 | A | 7/1984 | Flederbach et al. |
| 4,464,000 | A | 8/1984 | Werth et al. |
| 4,464,001 | A | 8/1984 | Collins |
| 4,469,386 | A | 9/1984 | Ackerman |
| 4,470,657 | A | 9/1984 | Deacon |
| 4,484,792 | A | 11/1984 | Tengler et al. |
| 4,484,796 | A | 11/1984 | Sato et al. |
| 4,506,943 | A | 3/1985 | Drogo |
| 4,515,427 | A | 5/1985 | Smit |
| 4,525,017 | A | 6/1985 | Schildkraut et al. |
| 4,531,805 | A | 7/1985 | Werth |
| 4,533,191 | A | 8/1985 | Blackwood |
| 4,540,231 | A | 9/1985 | Forney, Jr. |
| RE31,995 | E | 10/1985 | Ball |
| 4,545,637 | A | 10/1985 | Bosshard et al. |
| 4,575,274 | A | 3/1986 | Hayward |
| 4,580,862 | A | 4/1986 | Johnson |
| 4,580,865 | A | 4/1986 | Fryberger |
| 4,583,811 | A | 4/1986 | McMills |
| 4,585,289 | A | 4/1986 | Bocher |
| 4,588,246 | A | 5/1986 | Schildkraut et al. |
| 4,593,964 | A | 6/1986 | Forney, Jr. et al. |
| 4,596,434 | A | 6/1986 | Saba et al. |
| 4,596,435 | A | 6/1986 | Bickford |
| 4,598,961 | A | 7/1986 | Cohen |
| 4,600,263 | A | 7/1986 | DeChamp et al. |
| 4,613,199 | A | 9/1986 | McGeary |
| 4,614,390 | A | 9/1986 | Baker |
| 4,616,900 | A | 10/1986 | Cairns |
| 4,632,487 | A | 12/1986 | Wargula |
| 4,634,213 | A | 1/1987 | Larsson et al. |
| 4,640,572 | A | 2/1987 | Conlon |
| 4,645,281 | A | 2/1987 | Burger |
| 4,650,228 | A | 3/1987 | McMills et al. |
| 4,655,159 | A | 4/1987 | McMills |
| 4,655,534 | A | 4/1987 | Stursa |
| 4,660,921 | A | 4/1987 | Hauver |
| 4,668,043 | A | 5/1987 | Saba et al. |
| 4,674,818 | A | 6/1987 | McMills et al. |
| 4,676,577 | A | 6/1987 | Szegda |
| 4,682,832 | A | 7/1987 | Punako et al. |
| 4,684,201 | A | 8/1987 | Hutter |
| 4,688,876 | A | 8/1987 | Morelli |
| 4,688,878 | A | 8/1987 | Cohen et al. |

4,691,976 A 9/1987 Cowen
4,703,987 A 11/1987 Gallusser et al.
4,703,988 A 11/1987 Raux et al.
4,717,355 A 1/1988 Mattis
4,720,155 A 1/1988 Schildkraut et al.
4,734,050 A 3/1988 Negre et al.
4,734,666 A 3/1988 Ohya et al.
4,737,123 A 4/1988 Paler et al.
4,738,009 A 4/1988 Down et al.
4,738,628 A 4/1988 Rees
4,746,305 A 5/1988 Nomura
4,747,786 A 5/1988 Hayashi et al.
4,749,821 A 6/1988 Linton et al.
4,755,152 A 7/1988 Elliot et al.
4,757,297 A 7/1988 Frawley
4,759,729 A 7/1988 Kemppainen et al.
4,761,146 A 8/1988 Sohoel
4,772,222 A 9/1988 Laudig et al.
4,789,355 A 12/1988 Lee
4,806,116 A 2/1989 Ackerman
4,807,891 A 2/1989 Neher
4,808,128 A 2/1989 Werth
4,813,886 A 3/1989 Roos et al.
4,820,185 A 4/1989 Moulin
4,834,675 A 5/1989 Samchisen
4,835,342 A 5/1989 Guginsky
4,836,801 A 6/1989 Ramirez
4,838,813 A 6/1989 Pauza et al.
4,854,893 A 8/1989 Morris
4,857,014 A 8/1989 Alf et al.
4,867,706 A 9/1989 Tang
4,869,679 A 9/1989 Szegda
4,874,331 A 10/1989 Iverson
4,892,275 A 1/1990 Szegda
4,902,246 A 2/1990 Samchisen
4,906,207 A 3/1990 Banning et al.
4,915,651 A 4/1990 Bout
4,921,447 A 5/1990 Capp et al.
4,923,412 A 5/1990 Morris
4,925,403 A 5/1990 Zorzy
4,927,385 A 5/1990 Cheng
4,929,188 A 5/1990 Lionetto et al.
4,938,718 A 7/1990 Guendel
4,941,846 A 7/1990 Guimond et al.
4,952,174 A 8/1990 Sucht et al.
4,957,456 A 9/1990 Olson et al.
4,973,265 A 11/1990 Heeren
4,979,911 A 12/1990 Spencer
4,990,104 A 2/1991 Schieferly
4,990,105 A 2/1991 Karlovich
4,990,106 A 2/1991 Szegda
4,992,061 A 2/1991 Brush, Jr. et al.
5,002,503 A 3/1991 Campbell et al.
5,007,861 A 4/1991 Stirling
5,011,422 A 4/1991 Yeh
5,011,432 A 4/1991 Sucht et al.
5,021,010 A 6/1991 Wright
5,024,606 A 6/1991 Ming-Hwa
5,030,126 A 7/1991 Hanlon
5,037,328 A 8/1991 Karlovich
5,046,964 A 9/1991 Welsh et al.
5,052,947 A 10/1991 Brodie et al.
5,055,060 A 10/1991 Down et al.
5,062,804 A 11/1991 Jamet et al.
5,066,248 A 11/1991 Gaver, Jr. et al.
5,073,129 A 12/1991 Szegda
5,080,600 A 1/1992 Baker et al.
5,083,943 A 1/1992 Tarrant
5,120,260 A 6/1992 Jackson
5,127,853 A 7/1992 McMills et al.
5,131,862 A 7/1992 Gershfeld
5,137,470 A 8/1992 Doles
5,137,471 A 8/1992 Verespej et al.
5,141,448 A 8/1992 Mattingly et al.
5,141,451 A 8/1992 Down
5,149,274 A 9/1992 Gallusser et al.
5,154,636 A 10/1992 Vaccaro et al.
5,161,993 A 11/1992 Leibfried, Jr.
5,166,477 A 11/1992 Perin, Jr. et al.
5,169,323 A 12/1992 Kawai et al.
5,181,161 A 1/1993 Hirose et al.
5,183,417 A 2/1993 Bools
5,186,501 A 2/1993 Mano
5,186,655 A 2/1993 Glenday et al.
5,195,905 A 3/1993 Pesci
5,195,906 A 3/1993 Szegda
5,205,547 A 4/1993 Mattingly
5,205,761 A 4/1993 Nilsson
5,207,602 A 5/1993 McMills et al.
5,215,477 A 6/1993 Weber et al.
5,217,391 A 6/1993 Fisher, Jr.
5,217,393 A 6/1993 Del Negro et al.
5,227,587 A 7/1993 Paterek
5,247,424 A 9/1993 Harris et al.
5,269,701 A 12/1993 Leibfried, Jr.
5,283,853 A 2/1994 Szegda
5,284,449 A 2/1994 Vaccaro
5,294,864 A 3/1994 Do
5,295,864 A 3/1994 Birch et al.
5,316,494 A 5/1994 Flanagan et al.
5,318,459 A 6/1994 Shields
5,334,032 A 8/1994 Myers et al.
5,334,051 A 8/1994 Devine et al.
5,338,225 A 8/1994 Jacobsen et al.
5,342,218 A 8/1994 McMills et al.
5,354,217 A 10/1994 Gabel et al.
5,362,250 A 11/1994 McMills et al.
5,371,819 A 12/1994 Szegda
5,371,821 A 12/1994 Szegda
5,371,827 A 12/1994 Szegda
5,380,211 A 1/1995 Kawaguchi et al.
5,389,005 A 2/1995 Kodama
5,393,244 A 2/1995 Szegda
5,413,504 A 5/1995 Kloecker et al.
5,431,583 A 7/1995 Szegda
5,435,745 A 7/1995 Booth
5,439,386 A 8/1995 Ellis et al.
5,444,810 A 8/1995 Szegda
5,455,548 A 10/1995 Grandchamp et al.
5,456,611 A 10/1995 Henry et al.
5,456,614 A 10/1995 Szegda
5,466,173 A 11/1995 Down
5,470,257 A 11/1995 Szegda
5,474,478 A 12/1995 Ballog
5,490,801 A 2/1996 Fisher, Jr. et al.
5,494,454 A 2/1996 Johnsen
5,499,934 A 3/1996 Jacobsen et al.
5,501,616 A 3/1996 Holliday
5,516,303 A 5/1996 Yohn et al.
5,525,076 A 6/1996 Down
5,542,861 A 8/1996 Anhalt et al.
5,548,088 A 8/1996 Gray et al.
5,550,521 A 8/1996 Bernaud et al.
5,564,938 A 10/1996 Shenkal et al.
5,571,028 A 11/1996 Szegda
5,586,910 A 12/1996 Del Negro et al.
5,595,499 A 1/1997 Zander et al.
5,598,132 A 1/1997 Stabile
5,607,325 A 3/1997 Toma
5,620,339 A 4/1997 Gray et al.
5,632,637 A 5/1997 Diener
5,632,651 A 5/1997 Szegda
5,644,104 A 7/1997 Porter et al.
5,651,698 A 7/1997 Locati et al.
5,651,699 A 7/1997 Holliday
5,653,605 A 8/1997 Woehl et al.
5,667,405 A 9/1997 Holliday
5,681,172 A 10/1997 Moldenhauer
5,683,263 A 11/1997 Hse
5,702,263 A 12/1997 Baumann et al.
5,722,856 A 3/1998 Fuchs et al.
5,735,704 A 4/1998 Anthony
5,746,617 A 5/1998 Porter, Jr. et al.
5,746,619 A 5/1998 Harting et al.
5,769,652 A 6/1998 Wider
5,775,927 A 7/1998 Wider
5,863,220 A 1/1999 Holliday
5,877,452 A 3/1999 McConnell 5,879,191 A 3/1999 Burris
5,882,226 A 3/1999 Bell et al.
5,921,793 A 7/1999 Phillips
5,938,465 A 8/1999 Fox, Sr.
5,944,548 A 8/1999 Saito
5,957,716 A 9/1999 Buckley et al.
5,967,852 A 10/1999 Follingstad et al.
5,975,949 A 11/1999 Holliday et al.
5,975,951 A 11/1999 Burris et al.
5,977,841 A 11/1999 Lee et al.
5,997,350 A 12/1999 Burris et al.
6,010,349 A 1/2000 Porter, Jr.
6,019,635 A 2/2000 Nelson
6,022,237 A 2/2000 Esh
6,032,358 A 3/2000 Wild
6,042,422 A 3/2000 Youtsey
6,048,229 A 4/2000 Lazaro, Jr.
6,053,777 A 4/2000 Boyle
6,083,053 A 7/2000 Anderson, Jr. et al.
6,089,903 A 7/2000 Stafford Gray et al.
6,089,912 A 7/2000 Tallis et al.
6,089,913 A 7/2000 Holliday
6,123,567 A 9/2000 McCarthy
6,146,197 A 11/2000 Holliday et al.
6,152,753 A 11/2000 Johnson et al.
6,153,830 A 11/2000 Montena
6,210,216 B1 4/2001 Tso-Chin et al.
6,210,222 B1 4/2001 Langham et al.
6,217,383 B1 4/2001 Holland et al.
6,239,359 B1 5/2001 Lilienthal, II et al.
6,241,553 B1 6/2001 Hsia
6,261,126 B1 7/2001 Stirling
6,271,464 B1 8/2001 Cunningham
6,331,123 B1 12/2001 Rodrigues
6,332,815 B1 12/2001 Bruce
6,358,077 B1 3/2002 Young
D458,904 S 6/2002 Montena
6,406,330 B2 6/2002 Bruce
D460,739 S 7/2002 Fox
D460,740 S 7/2002 Montena
D460,946 S 7/2002 Montena
D460,947 S 7/2002 Montena
D460,948 S 7/2002 Montena
6,422,900 B1 7/2002 Hogan
6,425,782 B1 7/2002 Holland
D461,166 S 8/2002 Montena
D461,167 S 8/2002 Montena
D461,778 S 8/2002 Fox
D462,058 S 8/2002 Montena
D462,060 S 8/2002 Fox
6,439,899 B1 8/2002 Muzslay et al.
D462,327 S 9/2002 Montena
6,468,100 B1 10/2002 Meyer et al.
6,491,546 B1 12/2002 Perry
D468,696 S 1/2003 Montena
6,506,083 B1 1/2003 Bickford et al.
6,530,807 B2 3/2003 Rodrigues et al.
6,540,531 B2 4/2003 Syed et al.
6,558,194 B2 5/2003 Montena
6,572,419 B2 6/2003 Feye-Homann
6,576,833 B2 6/2003 Covaro et al.
6,619,876 B2 9/2003 Vaitkus et al.
6,676,446 B2 1/2004 Montena
6,683,253 B1 1/2004 Lee
6,692,285 B2 2/2004 Islam
6,692,286 B1 2/2004 De Cet
6,712,631 B1 3/2004 Youtsey
6,716,041 B2 4/2004 Ferderer et al.
6,716,062 B1 4/2004 Palinkas et al.
6,733,336 B1 5/2004 Montena et al.
6,733,337 B2 5/2004 Kodaira
6,767,248 B1 7/2004 Hung
6,780,068 B2 8/2004 Bartholoma et al.
6,786,767 B1 9/2004 Fuks et al.
6,790,081 B2 9/2004 Burris et al.
6,805,584 B1 10/2004 Chen
6,817,896 B2 11/2004 Derenthal
6,848,939 B2 2/2005 Stirling
6,848,940 B2 2/2005 Montena
6,884,113 B1 4/2005 Montena
6,884,115 B2 4/2005 Malloy
6,929,508 B1 8/2005 Holland
6,939,169 B2 9/2005 Islam et al.
6,971,912 B2 12/2005 Montena et al.
7,029,326 B2 4/2006 Montena
7,070,447 B1 7/2006 Montena
7,086,897 B2 8/2006 Montena
7,097,499 B1 8/2006 Purdy
7,102,868 B2 9/2006 Montena
7,114,990 B2 10/2006 Bence et al.
7,118,416 B2 10/2006 Montena et al.
7,125,283 B1 10/2006 Lin
7,131,868 B2 11/2006 Montena
7,144,271 B1 12/2006 Burris et al.
7,147,509 B1 12/2006 Burris et al.
7,156,696 B1 1/2007 Montena
7,161,785 B2 1/2007 Chawgo
7,229,303 B2 6/2007 Vermoesen et al.
7,252,546 B1 8/2007 Holland et al.
7,255,598 B2 8/2007 Montena et al.
7,299,550 B2 11/2007 Montena
7,375,533 B2 5/2008 Gale
7,393,245 B2 7/2008 Palinkas et al.
7,452,239 B2 11/2008 Montena
7,455,550 B1 11/2008 Sykes
7,462,068 B2 12/2008 Amidon
7,476,127 B1 1/2009 Wei
7,479,035 B2 1/2009 Bence et al.
7,488,210 B1 2/2009 Burris et al.
7,494,355 B2 2/2009 Hughes et al.
7,497,729 B1 3/2009 Wei
7,507,117 B2 3/2009 Amidon
7,544,094 B1 6/2009 Paglia et al.
7,566,236 B2 7/2009 Malloy et al.
7,607,942 B1 10/2009 Van Swearingen
7,674,132 B1 3/2010 Chen
7,682,177 B2 3/2010 Berthet
7,727,011 B2 6/2010 Montena et al.
7,753,705 B2 7/2010 Montena
7,794,275 B2 9/2010 Rodrigues
7,806,725 B1 10/2010 Chen
7,811,133 B2 10/2010 Gray
7,824,216 B2 11/2010 Purdy
7,828,595 B2 11/2010 Mathews
7,830,154 B2 11/2010 Gale
7,833,053 B2 11/2010 Mathews
7,845,976 B2 12/2010 Mathews
7,845,978 B1 12/2010 Chen
7,850,487 B1 12/2010 Wei
7,857,661 B1 12/2010 Islam
7,887,354 B2 2/2011 Holliday
7,892,005 B2 2/2011 Haube
7,892,024 B1 2/2011 Chen
7,927,135 B1 4/2011 Wlos
7,950,958 B2 5/2011 Mathews
8,029,315 B2 10/2011 Purdy et al.
8,062,044 B2 11/2011 Montena et al.
8,062,063 B2 * 11/2011 Malloy et al. ..... 439/578
8,075,337 B2 * 12/2011 Malloy et al. ..... 439/578
8,075,338 B1 12/2011 Montena
8,079,860 B1 12/2011 Zraik
8,113,875 B2 * 2/2012 Malloy et al. ..... 439/578
2002/0013088 A1 1/2002 Rodrigues et al.
2002/0038720 A1 4/2002 Kai et al.
2003/0214370 A1 11/2003 Allison et al.
2003/0224657 A1 12/2003 Malloy
2004/0077215 A1 4/2004 Palinkas et al.
2004/0102089 A1 5/2004 Chee
2004/0209516 A1 10/2004 Burris et al.
2004/0219833 A1 11/2004 Burris et al.
2004/0229504 A1 11/2004 Liu
2005/0042919 A1 2/2005 Montena
2005/0208827 A1 9/2005 Burris et al.
2005/0233636 A1 10/2005 Rodrigues et al.
2006/0099853 A1 5/2006 Sattele et al.
2006/0110977 A1 5/2006 Matthews
2006/0154519 A1 7/2006 Montena
2007/0026734 A1 2/2007 Bence et al.

| | | | | |
|---|---|---|---|---|
| 2007/0123101 | A1 | 5/2007 | Palinkas | |
| 2007/0175027 | A1 | 8/2007 | Khemakhem et al. | |
| 2008/0102696 | A1 | 5/2008 | Montena | |
| 2009/0029590 | A1 | 1/2009 | Sykes et al. | |
| 2009/0098770 | A1 | 4/2009 | Bence et al. | |
| 2010/0081321 | A1 | 4/2010 | Malloy et al. | |
| 2010/0081322 | A1 | 4/2010 | Malloy et al. | |
| 2010/0105246 | A1 | 4/2010 | Burris et al. | |
| 2010/0233901 | A1 | 9/2010 | Wild et al. | |
| 2010/0255721 | A1 | 10/2010 | Purdy et al. | |
| 2010/0279548 | A1 | 11/2010 | Montena et al. | |
| 2010/0297871 | A1 | 11/2010 | Haube | |
| 2010/0297875 | A1 | 11/2010 | Purdy | |
| 2011/0021072 | A1 | 1/2011 | Purdy | |
| 2011/0053413 | A1 | 3/2011 | Mathews | |
| 2011/0117774 | A1 | 5/2011 | Malloy et al. | |
| 2011/0143567 | A1 | 6/2011 | Purdy et al. | |
| 2011/0230089 | A1 | 9/2011 | Amidon et al. | |
| 2011/0230091 | A1 | 9/2011 | Krenceski et al. | |
| 2012/0021642 | A1* | 1/2012 | Zraik | 439/578 |
| 2012/0094532 | A1* | 4/2012 | Montena | 439/578 |
| 2012/0171894 | A1* | 7/2012 | Malloy et al. | 439/578 |

FOREIGN PATENT DOCUMENTS

| | | | |
|---|---|---|---|
| CN | 201149936 | Y | 11/2008 |
| CN | 201149937 | Y | 11/2008 |
| CN | 201178228 | Y | 1/2009 |
| DE | 47931 | C | 10/1888 |
| DE | 102289 | C | 4/1899 |
| DE | 1117687 | B | 11/1961 |
| DE | 1191880 | | 4/1965 |
| DE | 1515398 | B1 | 4/1970 |
| DE | 2225764 | A1 | 12/1972 |
| DE | 2221936 | A1 | 11/1973 |
| DE | 2261973 | A1 | 6/1974 |
| DE | 3211008 | A1 | 10/1983 |
| DE | 9001608.4 | U1 | 4/1990 |
| EP | 116157 | A1 | 8/1984 |
| EP | 167738 | A2 | 1/1986 |
| EP | 0072104 | A1 | 2/1986 |
| EP | 0265276 | A2 | 4/1988 |
| EP | 0428424 | A2 | 5/1991 |
| EP | 1191268 | A1 | 3/2002 |
| EP | 1501159 | A1 | 1/2005 |
| EP | 1701410 | A2 | 9/2006 |
| FR | 2232846 | A1 | 1/1975 |
| FR | 2234680 | A2 | 1/1975 |
| FR | 2312918 | | 12/1976 |
| FR | 2462798 | A1 | 2/1981 |
| FR | 2494508 | A1 | 5/1982 |
| GB | 589697 | A | 6/1947 |
| GB | 1087228 | A | 10/1967 |
| GB | 1270846 | A | 4/1972 |
| GB | 1401373 | A | 7/1975 |
| GB | 2019665 | A | 10/1979 |
| GB | 2079549 | A | 1/1982 |
| GB | 2252677 | A | 8/1992 |
| GB | 2264201 | A | 8/1993 |
| GB | 2331634 | A | 5/1999 |
| JP | 3280369 | B2 | 5/2002 |
| KR | 2006100622526 | B1 | 9/2006 |
| TW | 427044 | B | 3/2001 |
| WO | 8700351 | | 1/1987 |
| WO | 0186756 | A1 | 11/2001 |
| WO | 2004013883 | A2 | 2/2004 |
| WO | 2006081141 | A1 | 8/2006 |
| WO | 2011128665 | A1 | 10/2011 |
| WO | 2011128666 | A1 | 10/2011 |

* cited by examiner

COAXIAL CABLE CONNECTOR HAVING SLOTTED POST MEMBER

FIELD OF THE INVENTION

The present application generally relates to the field of coaxial cable connectors and more specifically to a coaxial cable connector that provides secure attachment with an external interface port while preventing premature loosening of same.

BACKGROUND OF THE INVENTION

Coaxial cable connectors are very well known in the field of communications, such as broadband communications, among other applications. A typical coaxial cable connector, such as an F-type connector, retains a coaxial cable end within a connector body. The connector further includes a rotatable threaded coupling nut that permits attachment of the connector to an appliance such as a television, computer or other device through an external interface port. A center conductor of the coaxial cable extends from the mating end of the connector and is retained within the complementary threaded port of the appliance. Reliable securement enables both electrical and mechanical interconnection to be made between the cable/connector and the device.

One pervasive problem relating to the engagement of the above types of coaxial cable connectors with an external appliance port is that the coupling nut associated with the connector can loosen over time due to several factors including a lack of adequate initial tightening of the nut, (i.e., improper number of turns), intentional or unintentional movement of the appliance, or other reasons.

Another general problem in the field relates to maintaining proper electrical continuity when the external appliance port is tightened onto the coaxial cable connector. Improper continuity can result in poor performance in which lack of shielding can lead to noise or other undesired electrical interference.

SUMMARY OF THE INVENTION

According to one aspect, a connector for a coaxial cable includes a connector body, a post member, and a coupling nut. The connector body has a first end, an opposing second end, and defines a central passageway extending therethrough along an axis. The post member has a first end and a second end. The post member second end is disposed within the connector body and the post member first end includes a flanged portion. At least a portion of the flanged portion is configured to provide a biasing force along the axis. The coupling nut is rotatably attached to the first end of the post member.

In one version, the flanged portion of the post member includes an arcuate slot wherein at least the flanged portion is made from a spring material, such as steel or brass. In one version, the formed slot is helical. According to another version, the slot is spiral. In yet another version, the slot is an angled cut. In at least one of the above versions, the radial face of the flanged portion of the post member is also angled. The creation of the formed slot creates an axial bias that permits the post member to be compressively engaged by an interface port and permits electrical continuity to be repeatably maintained without requiring complete compressive attachment.

According to another aspect a coaxial cable connector includes a connector body having a hollow interior along an axis, and a post member having a first end and a second end.

The first end includes a flanged portion that is axially and elastically compressible, and the second end is disposed within the connector body and axially secured thereto. The coaxial cable connector further includes a coupling nut rotatably secured and in overlaying relation to the first end of the post member.

According to yet another aspect, there is described a method of manufacturing a coaxial cable connector that permits electrical continuity between an interface port and the connector to be maintained during the entirety of an attachment procedure with the port. The method includes the steps of providing a connector body, rotatably attaching a nut in relation to one end of the connector body, and providing a post member within the connector body. The post member has a first end positioned within the nut and a second end extending into the interior of the connector body and axially secured therewith. The first end has a flanged portion, and the method further includes the step of forming a slot in the flanged portion. The flanged portion is made from a spring material, and the flanged portion has an angled face. The angled face is biased into a first position, wherein an interface port can be attached to the coaxial cable connector through threading engagement between the port and the coupling nut, causing the angled face and the slot of the flanged portion to be compressed to a second position and in which the biasing force of the flanged portion maintains electrical continuity between the post member and the port even when the nut is loosened from a fully tightened condition.

One advantage provided by the herein described coaxial cable connector is simpler assembly for use with fewer components than other known connectors, thereby also reducing cost.

Another advantage is that the herein described coaxial cable connector is versatility and improved reliability, as compared with prior art connectors.

These and other features and advantages will become readily apparent from the following Detailed Description, which should be read in conjunction with the accompanying drawings.

DETAILED DESCRIPTION OF THE INVENTION

The following description relates to certain exemplary embodiments of a coaxial cable connector or connector assembly, the connector including means for providing a biasing force onto an external port attached to the connector upon application of a force from a coupling nut. The connector described herein is an F-type compression coaxial connector, though it will be readily apparent that other coaxial cable connectors such as, for example, RCA-type, BNC and other suitable types of connectors that can be attached releasably to an external interface port can also be suitably used. In addition, certain terms such as "distal", "proximal", "inner", "outer", "above', "below" and the like are used throughout the course of discussion in order to provide a suitable frame of reference with regard to the accompanying drawings. These terms should not be regarded as overlimiting, however, except where so specifically indicated herein.

Figure 1:
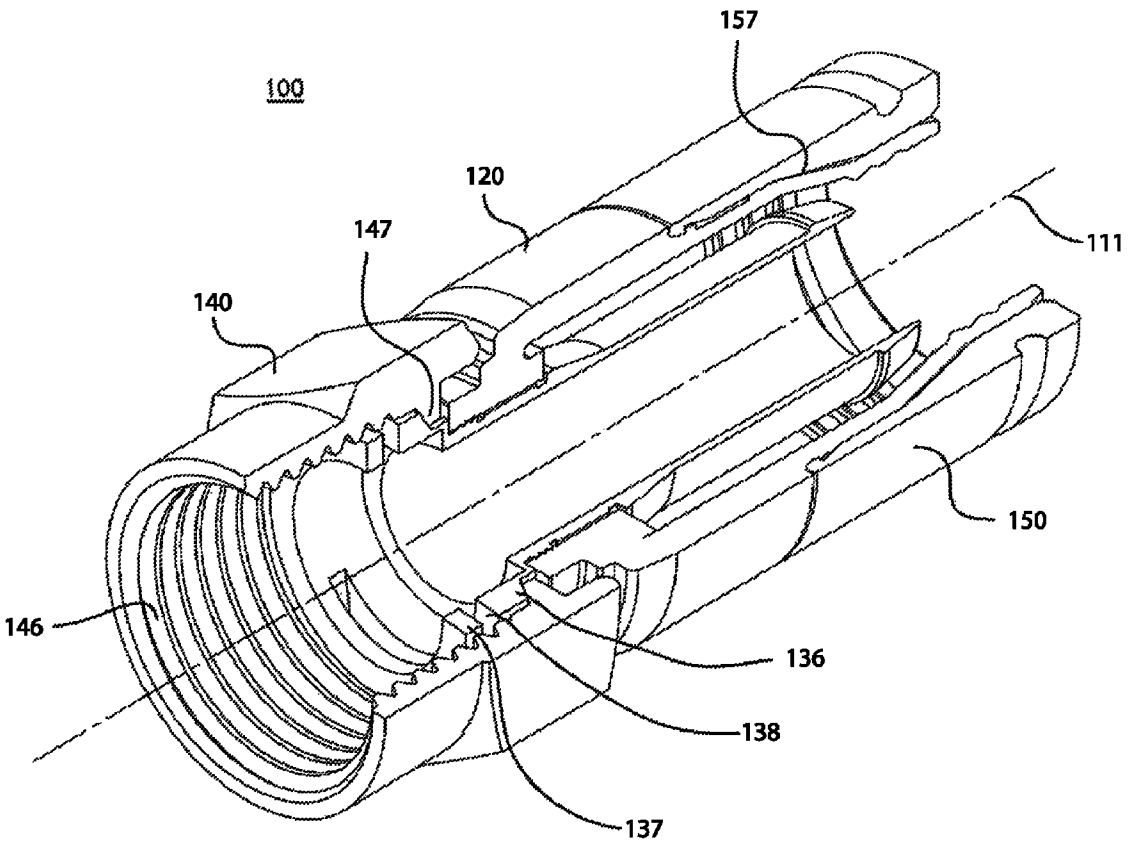
FIG. 1 is a perspective view of a coaxial cable connector assembly, partially broken away in section, which is made in accordance with a first embodiment of the present invention.
Figure 2:
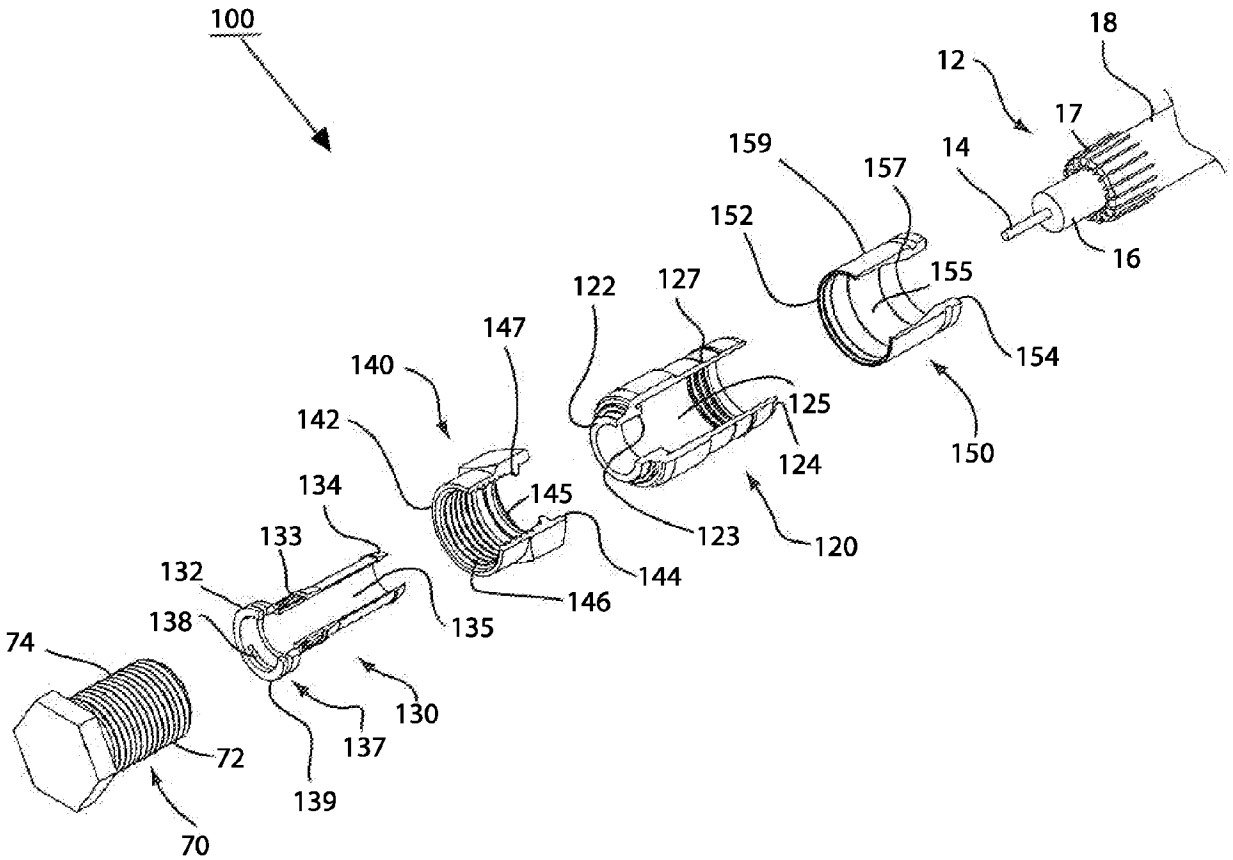
FIG. 2 is an exploded perspective view, portions thereof partially broken away in section, of the coaxial cable connector assembly of FIG. 1.

Referring to FIGS. 1 and 2, there is shown a connector assembly 100 in accordance with a first embodiment. The connector assembly 100 is manufactured from a plurality of components including a connector body 120, an inner post member 130, a coupling nut 140 and a compression member or sleeve 150.

The connector body 120 is defined by a substantially hollow cylindrical section further defined by a first end 122 and an opposing second end 124, wherein the ends are connected by a central passageway 125 extending therethrough. The center passageway 125 is defined by adjacent bores having different diameters; namely, a first interior diameter adjacent the first end 122, which is necked, and a second larger interior diameter adjacent the second end 124. The connector body 120 further includes a post securing portion 123 adjacent the first end 122, as well as a deformable axial portion 127 adjacent to the second end 124. The deformable axial portion 127 is made from an elastomeric material, which is deformable under sufficient applied forces. The remainder of the connector body 120 can be made from any suitable material, including metal and/or plastic.

As shown in FIGS. 1 and 2, the inner post member 130 is a hollow, substantially tubular section having a first end 132 with a tapering cross section that is sized to be fitted into the first end 122 of the connector body 120. The inner post member 130 further includes at least one exterior surface feature 133 that enables securement to the post securing portion 123 of the connector body 120, permitting the post to be axially as well as rotationally disposed within the connector assembly 100. The first end 132 of the inner post member 130 includes an annular flanged portion 137 that includes a center opening as well as a radial face 139. The first and second ends 132, 134 are interconnected by a center passageway 135 that extends entirely through the inner post member 130. The flanged portion 137 further includes an arcuate slot 138 angled approximately five degrees relative to the end plane of the post member 130 (the latter of which is substantially perpendicular to the longitudinal or primary axis of the inner post member 130 and connector assembly 100). This slot 138 can be made by means of milling, grinding, cutting, or other suitable process. The flanged portion 137 of the post member 130, at a minimum according to this embodiment, is made from a material providing elastic properties, such as steel or brass for example. The radial face 139 of the flanged portion 137 is formed at an angle substantially parallel to the angle of the slot 138, which according to this exemplary embodiment is approximately five (5) degrees relative to the radial end plane (which, as noted above, is substantially perpendicular to the longitudinal or primary axis 111 of the inner post member 130 and connector assembly 100).

Still referring to FIGS. 1 and 2, the coupling nut 140 is also defined by a first end 142 and an opposing second end 144 that is interconnected by a center passageway or bore 145. At least an axial interior portion of the coupling nut 140 is threaded. For purposes of the herein described embodiment, the entire axial length of the nut 140 or a selected portion thereof can include threads 146. The coupling nut 140 further includes a proximal end flange 147 adjacent the second end 144. The coupling nut 140 is secured according to this embodiment to the flanged portion 137 of the inner post member 130 for free rotation and is movable axially between first and second positions. When rotated, the proximal end flange 147 of the coupling nut 140 is caused to engage against a corresponding end flange 136 of the inner post 130. Alternatively, the coupling nut 140 can be axially secured to either the connector body 120 and/or the post member 130 while still being freely rotatable.

The compression member 150 according to this exemplary embodiment is defined as a substantially cylindrical section, such as a sleeve, which is further defined by a first end 152 and an opposing second end 154, the two ends being interconnected by a central passageway 155. The central passageway 155 includes a conical surface 157 adjacent the first end 152 that generally tapers from a larger first diameter adjacent the first end to a smaller second diameter extending to the second end 154. The compression member 150 can be made from steel, plastic or other suitable material. In one version, the exterior surface 159 of this compression member 150 is knurled for ease of use or can alternatively include an elastomeric covering.

A prepared end of a coaxial cable 12, shown only in FIG. 2, is secured to the herein described coaxial cable connector 100. As shown only in FIG. 2, the coaxial cable 12 is defined by a center conductor 14, an intermediate dielectric layer 16, a shielding layer 17, which can include braiding and an outer covering or sleeve 18. In preparing the cable end, an axial portion of the outer covering 18 is stripped away as is a portion of the dielectric layer 17, exposing an axial portion of the dielectric layer 16 and center conductor 14. A portion of the dielectric layer 17 is also stripped or cored away, leaving an exposed axial section of the center conductor 14.

For purposes of the herein described connector 100 and still referring to FIG. 2, the prepared cable end is inserted into the second end 124 of the connector body 120 and engaged between the intermediate dielectric layer 16 and the grounding shield layer 17 by means of the extending barbed second end 134 of the inner post member 130. The grounding shield layer 17 and the outer sleeve 18 of the cable 12 are retained in an annular space or pocket formed between the connector body 120 and the inner post member 130, while the center conductor 14 and intermediate dielectric portion 16 of the prepared coaxial cable end pass through the center passageway 135 of the post member 130. The extending center conductor 14 is advanced through the center opening of the first end 132 of the post member 130 into the center bore 145 of the coupling nut 140. The compression member 150 is then axially advanced over the exterior of the connector body 120 using a compression tool (not shown) or other suitable means, wherein the ramped interior surface 157 engages the deformable axial portion 127 of the connector body 120, causing this portion to radially deform inwardly and securing the coaxial cable end 12 into position.

As shown in FIGS. 2-5, the coaxial cable connector 100, including the secured coaxial cable end 12 (not shown in FIGS. 3-5 for purposes of clarity) can receive an external interface port 70, the port including a distal end 72 that further includes a set of external threads 74. The threads 74 of the interface port 70 include a pitch and height that corresponds with or complement those of the internal threads 146 of the coupling nut 140. It will be understood that though the herein described external port 70 is threaded, the above concepts will also operate similarly for RCA-type connectors, such as those described in U.S. Pat. No. 7,462,068, the entire contents of which are herein incorporated by reference.

Figure 3:
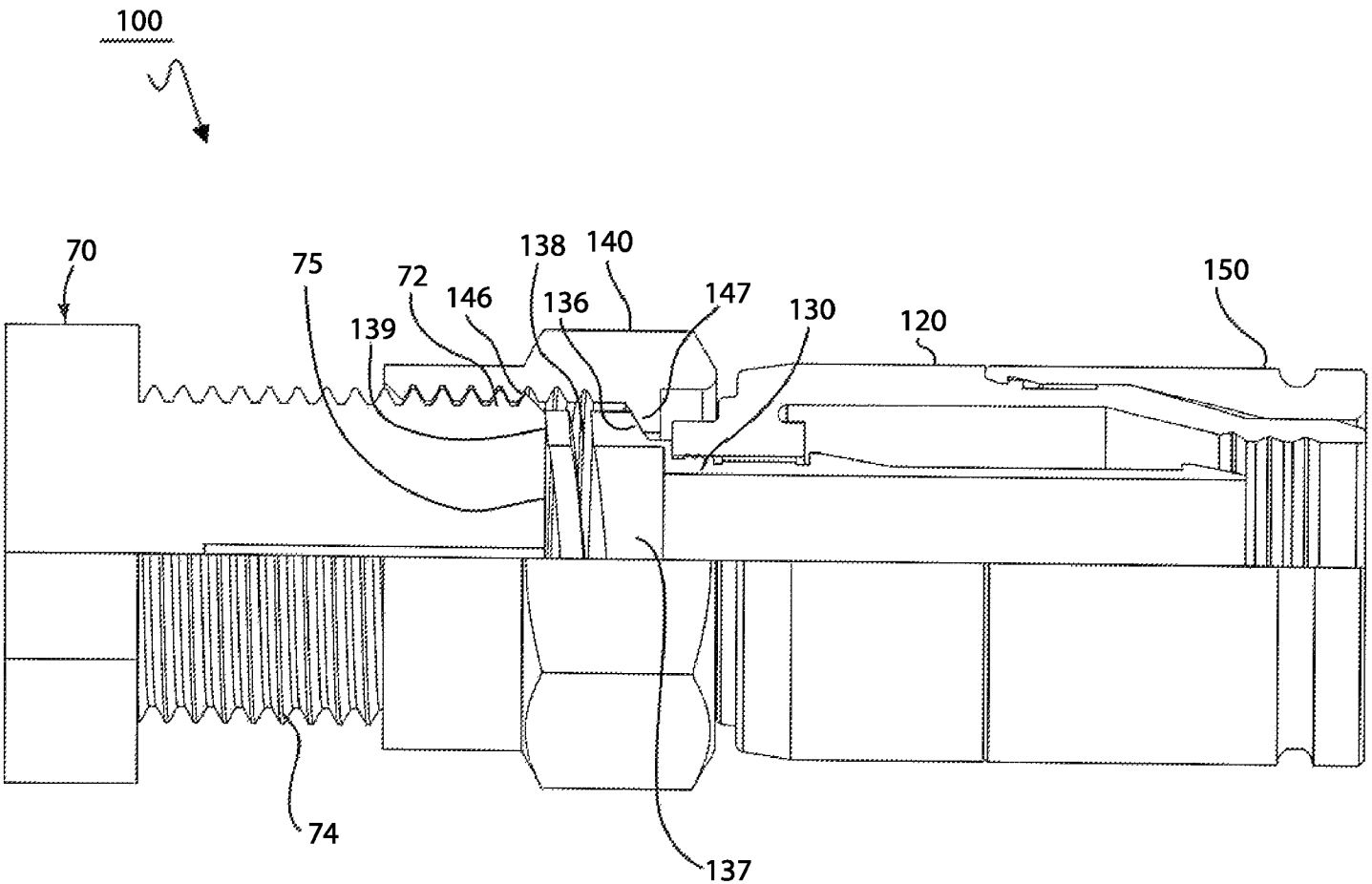
FIG. 3 is a sectioned elevational view of the coaxial cable connector assembly of FIGS. 1 and 2, in a first position.
Figure 4:
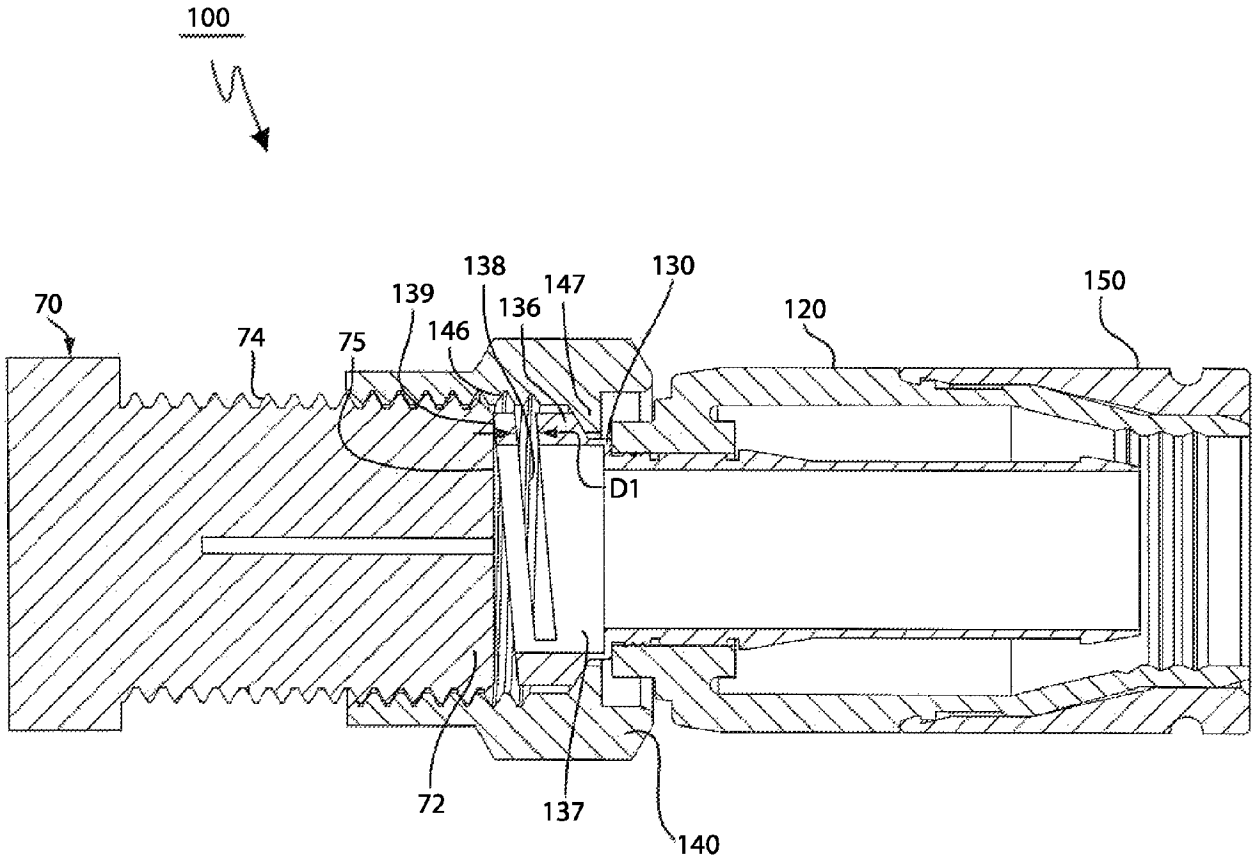
FIG. 4 is the cross-sectional elevational view of the coaxial cable connector assembly of FIG. 3.
Figure 5:
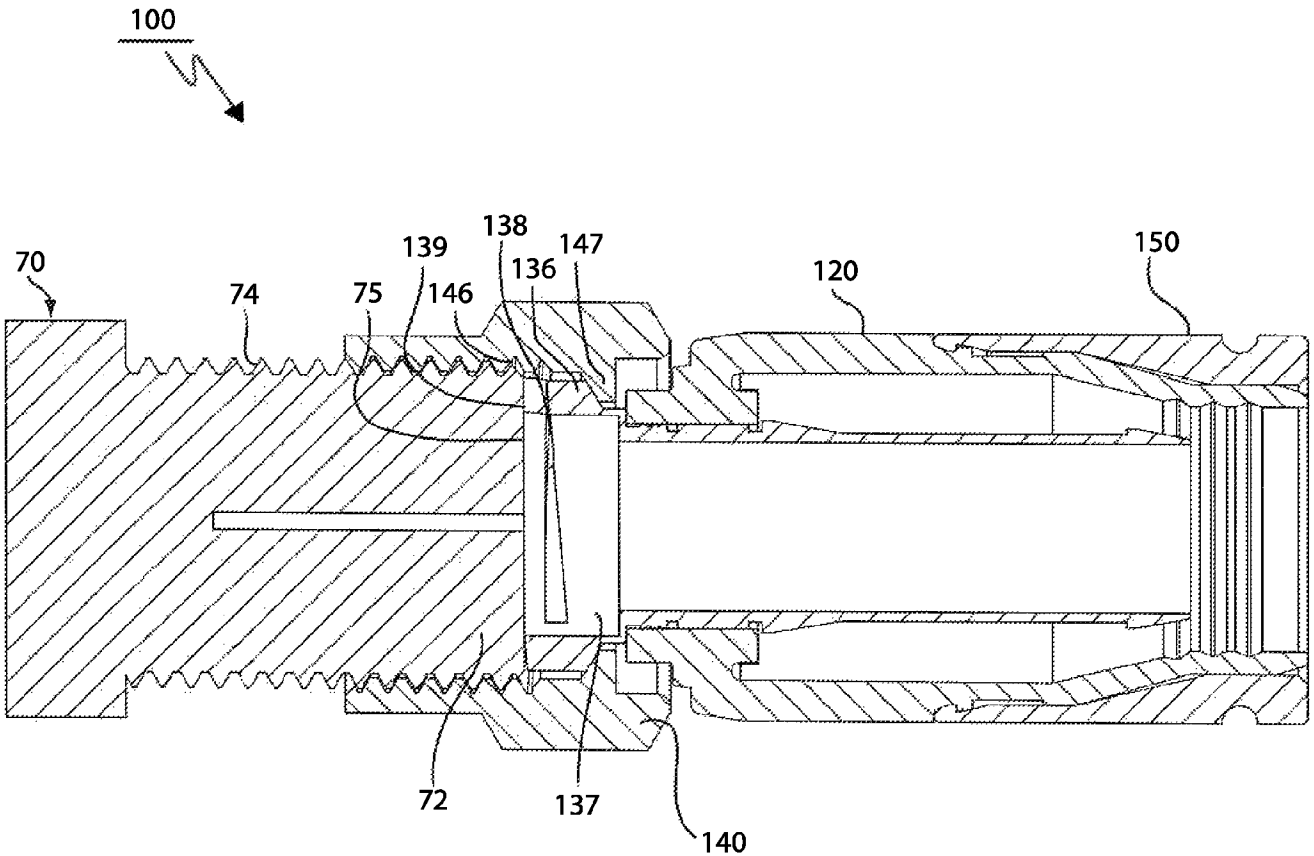
FIG. 5 is the cross-sectioned elevational view of the coaxial cable connector assembly of FIGS. 1-2, shown in a second position.

As the interface port 70 is tightened onto the coaxial cable connector 100 by threading engagement of the coupling nut 140 as shown in FIGS. 3-5, a radial face 75 at the distal end 72 of the interface port 70 engages directly with the angled face 139 of the inner post member 130. This engagement creates a compressive force against the flanged first end 132 of the inner post member 130 as the coupling nut 140 continues to be tightened and causes compression thereof over a working distance D1 as the slot 137 is closed. In the event loosening of the coupling nut 140 takes place, the radial face 75 is maintained in contact with the radial face 139 of the inner post member 130 based on the biasing force applied by the angled slot 138. As a result, interconnection and electrical continuity are each maintained.

It will be readily apparent that additional or alternative versions of an inner post that is suitably and flexibly compressible in relation to an attached interface port are possible. For example and referring to FIGS. 6-8, wherein like numerals indicate like elements, there is illustrated a coaxial connector assembly 200, the assembly also having a plurality of components. The connector assembly 200, like the preceding version, includes a connector body 220, an inner post member 230, a coupling nut 240 and a compression member or sleeve 250.

As in the preceding embodiment, the connector body 220 is defined by a substantially hollow cylindrical section further defined by a first end 222 and an opposing second end 224, wherein the ends are connected by a central passageway 225 extending therethrough. The center passageway 225 is defined by adjacent bores having different diameters; namely, a first interior diameter adjacent the first end 222 which is necked, and a second larger interior diameter adjacent the second end 224. The connector body 220 further includes a post securing portion 223 adjacent the first end 222, as well as a deformable axial portion 227 adjacent to the second end 224. The deformable axial portion 227 is made from an elastomeric material, which is deformable under sufficient applied forces. As in the preceding, the remainder of the connector body 220 can be made from any suitable material, including metal and/or plastic.

Figure 6:
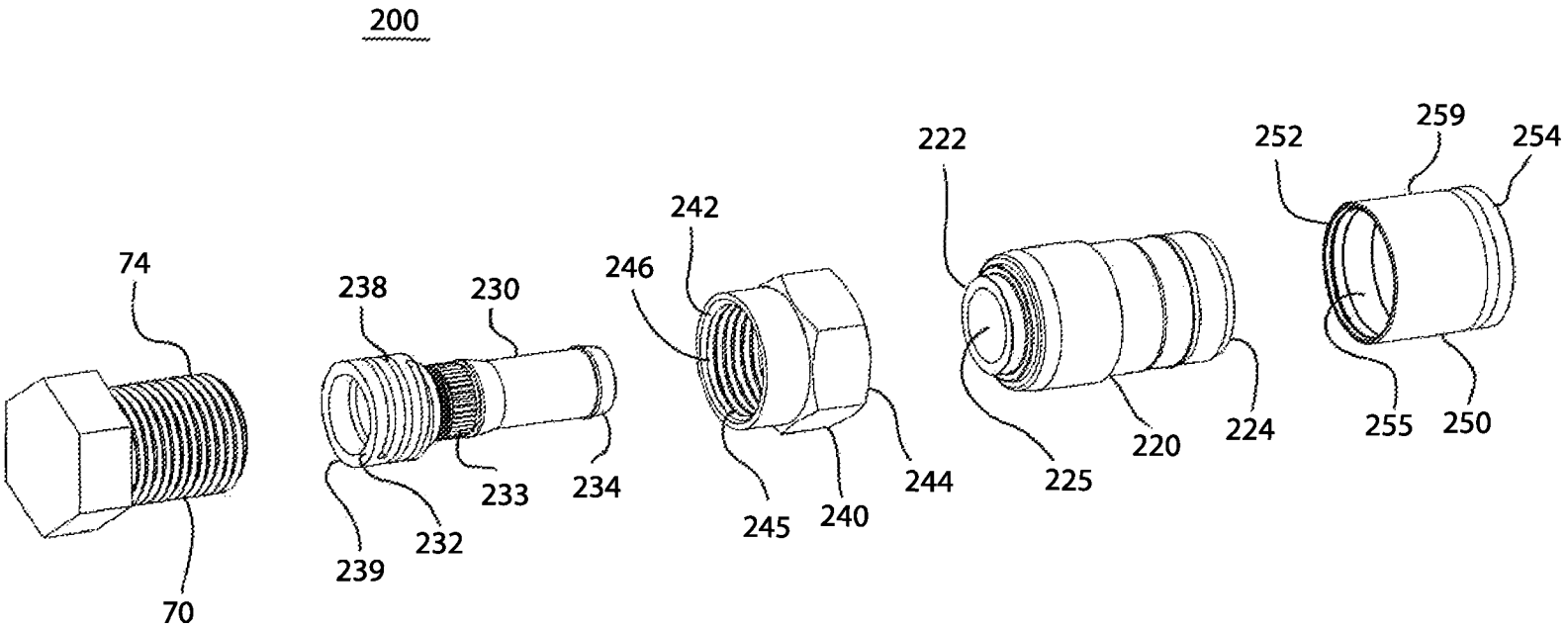
FIG. 6 is an exploded perspective view of a coaxial cable connector assembly in accordance with another exemplary embodiment.
Figure 7:
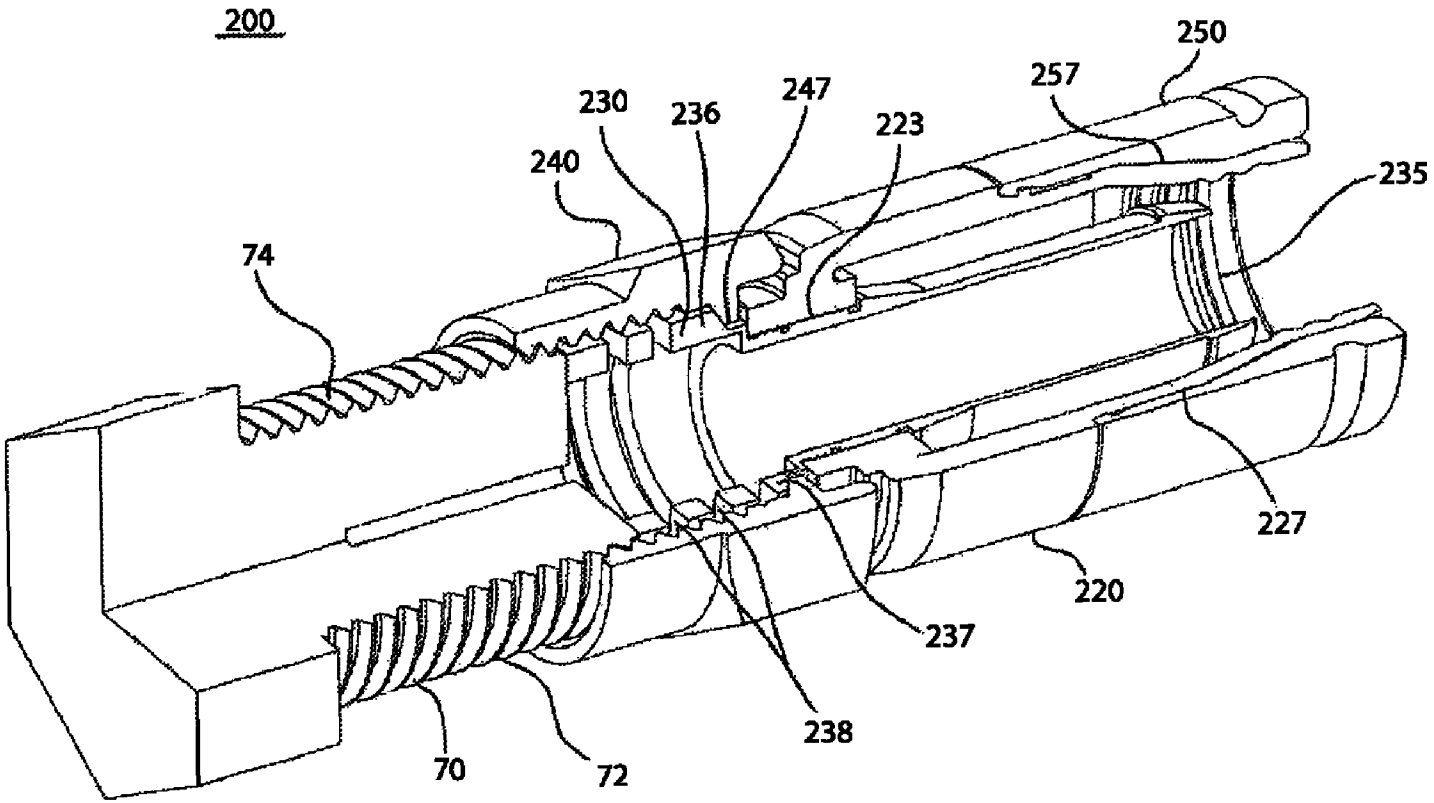
FIG. 7 is a sectioned, perspective assembly view of the coaxial cable connector assembly of FIG. 6.

As shown in FIGS. 6 and 7 and also like the preceding, the inner post member 230 is a hollow, substantially tubular section having a first end 232 having a tapering cross section that is sized to be fitted into the first end 222 of the connector body 220. The inner post member 230 further includes at least one exterior surface feature 233 that enables securement of the post member to the post securing portion 223 of the connector body 220, thereby permitting the post member to be axially as well as rotationally secured to the connector assembly 200. The first end 232 of the inner post member 230 includes an annular flanged portion 237 that includes a center opening as well as a radial face 239. The first and second ends 232, 234 are interconnected by a center passageway 235 that extends entirely through the post member 230. Unlike the preceding embodiment, the flanged portion 237 further includes a helically wound slot 238. This helical slot 238 can be made by means of milling, grinding, cutting, or other suitable process wherein the angle of the helical cut made is substantially between about 3 and 5 degrees in relation to the radial end plane of the inner post member (the latter of which is substantially perpendicular to the primary or longitudinal axis of the inner post member 230 and connector assembly 200). The flanged portion 237 of the inner post member 230, at a minimum according to this embodiment, is made from a material providing elastic properties, such as steel or brass, for example. Unlike the preceding embodiment, however, the radial face 239 of the flanged portion 237 is not angled in relation to the angle of the defined helical slot 238 but rather the radial face 239 is substantially perpendicular to the longitudinal or primary axis 211 of the inner post member 230 and connector assembly 200).

Still referring to FIGS. 6 and 7 and like the preceding, the coupling nut 240 is also defined by a first end 242 and an opposing second end 244 that is interconnected by a center passageway or bore 245. At least an axial interior portion of the coupling nut 240 is threaded. For purposes of the herein described embodiment, the entire axial length of the nut 240 or a selected portion thereof can include threads 246. The coupling nut 240 further includes a rear end flange 247 adjacent the second end 244. The coupling nut 240 is secured according to this embodiment to the inner post member 230 for free rotation and is movable axially between first and second positions in which the end flange 247 engages an end flange 236 of the inner post member 230. Alternatively, the coupling nut 240 can be axially secured to either the connector body 220 and/or the post member 230 while still being freely rotatable.

The compression member 250 according to this exemplary embodiment is defined as a substantially cylindrical section, such as a sleeve, which is further defined by a first end 252 and an opposing second end 254, the two ends being interconnected by a central passageway 255. The central passageway 255 includes a conical surface 257 adjacent the first end 252 that generally tapers from a larger first diameter adjacent the first end to a smaller second diameter extending to the second end 254. The compression member 250 can be made from steel, plastic or other suitable material. In one version, the exterior surface 259 of this compression member 250 is knurled for ease of use or can alternatively include an elastomeric covering.

Figure 8:
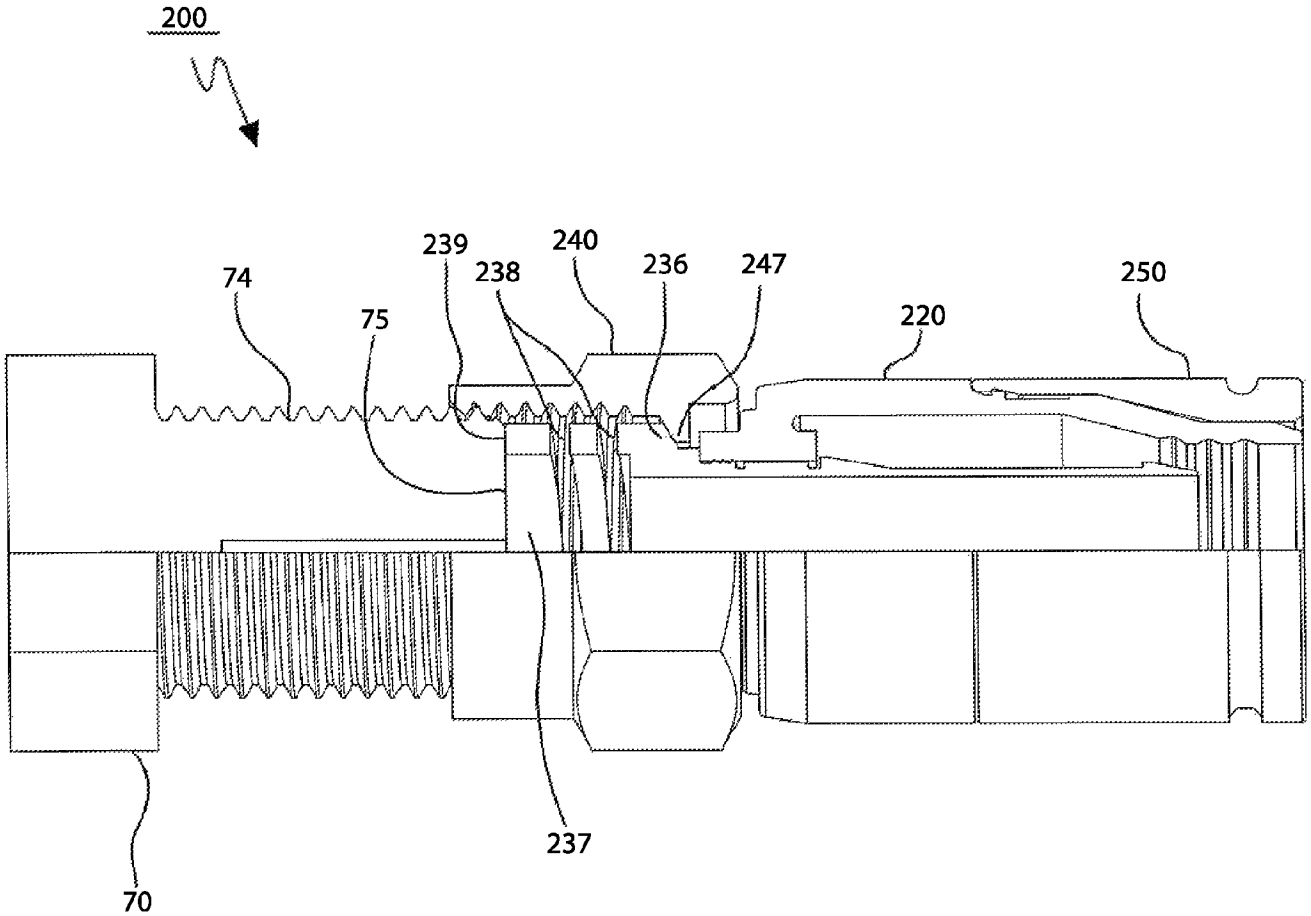
FIG. 8 is a sectioned, elevational view of the coaxial cable connector assembly of FIG. 6, in a first position in relation to an attached interface port.

In operation, a coaxial cable (not shown) is prepared and attached to the compression member side of the connector assembly 200, in the manner previously described. With reference to FIG. 8, the coupling nut 240 is attached such that the nut can freely rotate wherein the flanged portion 237 of the inner post member 230 is mounted within the interior of the coupling nut 240 such that the end flange 247 of the nut engages with a corresponding end flange 236 of the inner post member 230. As the interface port 70 is engaged with the connector assembly 200, the radial face 75 of the interface port 70 is caused to engage with the radial face 239 of the inner post member 230, causing the flanged portion 237, including the helical slot 238 to close as the coupling nut 240 is tightened. As in the preceding, loosening of the coupling nut 240 following attachment of the interface port 70 still provides substantial contact between the radial end faces 239, 75 of the inner post member 230 and the interface port 70, respectively, based on the bias provided by the helical slot 238.

Though the invention has been described with regard to certain embodiments, it will be readily apparent that other modifications and variations are possible within the intended scope of the claims as follows.

What is claimed is:

1. A coaxial cable connector comprising:

a connector body having a first end, an opposing second end, and defining a central passageway extending therethrough along an axis;

a post member having a first end and a second end, the post member second end being disposed within the connector body and the post member first end including a flanged portion, at least a portion of the flanged portion configured to provide a biasing force along the axis; and a coupling nut rotatably attached to the first end of the post member.

2. A connector as recited in claim 1, wherein the flanged portion of the post member includes a helical slot to provide the axial biasing force.

3. A connector as recited in claim 1, wherein the flanged portion of the post member includes an angled slot to provide the axial biasing force.

4. A connector as recited in claim 3, wherein a radial face of the flanged portion of the post member is angled with respect to a plane perpendicular to the axis.

5. A connector as recited in claim 4, wherein the radial face is parallel to the angle of the slot.

6. A connector as recited in claim 1, wherein each of the post member and the port are made from electrically conductive materials.

7. A connector as recited in claim 1, wherein the connector is an F-type connector.

8. A coaxial cable connector, the connector comprising:

a connector body having a hollow interior along an axis;

a post member having a first end and a second end, the first end including a flanged portion being axially and elastically compressible, the second end being disposed within the connector body and axially secured thereto; and a coupling nut rotatably secured and in overlaying relation to the first end of the post member.

9. A connector as recited in claim 8, wherein the flanged portion of the post member includes at least one angled slot.

10. A connector as recited in claim 8, wherein the connector is an F-type connector.

11. A connector as recited in claim 8, wherein the flanged portion of the post member includes a radial face, the face being angled parallel to the angle of the formed slot.

12. A connector as recited in claim 8, wherein the slot is helical.

13. A connector as recited in claim 8, wherein the slot is spiral.

14. A method of manufacturing a coaxial cable connector that permits electrical continuity between an interface port and the connector to be maintained during the entirety of an attachment procedure with the interface port, the method comprising the steps of:

providing a hollow connector body;

rotatably attaching a nut in relation to one end of the connector body;

providing a post member within the connector body, the post member having a first end positioned within the nut and a second end extending into the interior of the connector body and axially secured therewith, the first end of the post member having a flanged portion; and forming a slot in the flanged portion of the post member, the flanged portion being made from a spring material, the flanged portion having an angled face wherein the angled face is axially biased into a first position;

wherein an interface port can be attached to the connector through threading engagement between the port and the nut causing the angled face and the slot of the flanged portion to be compressed to a second position and in which the axial biasing force of the flanged portion maintains electrical continuity between the post member and the interface port even when the nut is loosened from a fully tightened condition.

* * * * *